US009242473B2

(12) United States Patent
Kudo

(10) Patent No.: US 9,242,473 B2
(45) Date of Patent: Jan. 26, 2016

(54) LIQUID EJECTING APPARATUS, SELF-SEALING UNIT, AND LIQUID EJECTING HEAD

(71) Applicant: SEIKO EPSON CORPORATION, Tokyo (JP)

(72) Inventor: Yasuyuki Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/572,038

(22) Filed: Dec. 16, 2014

(65) Prior Publication Data

US 2015/0183226 A1 Jul. 2, 2015

(30) Foreign Application Priority Data

Dec. 26, 2013 (JP) ..... 2013-270568

(51) Int. Cl.
*B41J 2/175* (2006.01)

(52) U.S. Cl.
CPC ..... *B41J 2/17596* (2013.01)

(58) Field of Classification Search
USPC ..... 347/5, 7, 84, 85, 86
See application file for complete search history.

(56) References Cited

U.S. PATENT DOCUMENTS

| | | | | |
|---|---|---|---|---|
| 6,042,223 | A | 3/2000 | Katakura | |
| 7,258,407 | B1 * | 8/2007 | Stelter | B41J 2/1707 347/7 |
| 7,618,135 | B2 * | 11/2009 | Stathem | B41J 2/17596 347/86 |
| 2005/0073559 | A1 * | 4/2005 | Aruga | B41J 2/17509 347/85 |

FOREIGN PATENT DOCUMENTS

| | | |
|---|---|---|
| JP | 10-217452 | 8/1998 |
| JP | 2012-166420 | 9/2012 |

* cited by examiner

*Primary Examiner* — Lam Nguyen
(74) *Attorney, Agent, or Firm* — Workman Nydegger

(57) ABSTRACT

Provided is a self-sealing unit which has two films in a facing state, two end surfaces intersecting with the films, and a plurality of self-sealing valves. The self-sealing valves have diaphragm chambers which are formed by the films and valve bodies which move in accordance with displacement of the films and open/close flow paths. When viewed from a direction perpendicular to a plane to which the self-sealing unit is fixed, the length of a diagonal line connecting intersection points on sides of the diaphragm chambers is set to be longer than that of a diagonal line connecting intersection points on sides of the valve bodies.

16 Claims, 5 Drawing Sheets

LIQUID EJECTING APPARATUS, SELF-SEALING UNIT, AND LIQUID EJECTING HEAD

BACKGROUND

1. Technical Field

The present invention relates to a liquid ejecting apparatus, a self-sealing unit, and a liquid ejecting head. Particularly, the invention is useful to be applied to, for example, an ink jet type recording apparatus having a self-sealing unit which ejects ink as liquid.

2. Related Art

An ink jet type recording apparatus (hereinafter, also referred to as a recording apparatus) having, for example, an ink jet type recording head (hereinafter, also referred to as a recording head), in which recording is performed in such a manner that ink in a liquid state is ejected, as ink droplets, through nozzles of the recording head has been known as a representative example of a liquid ejecting apparatus.

In some of the recording apparatuses of such a type, an ink jet type recording head unit (hereinafter, referred to as a head unit) is constituted by a plurality of recording heads which have nozzle rows constituted by a plurality of rows of nozzles and are aligned and fixed to a sub-carriage and the head unit is mounted on a main carriage. In the recording head constituting the head unit, a type which has a liquid flow path through which liquid is supplied to a pressure generation chamber communicating with nozzles and causes ink droplets to be ejected through the nozzles, using the pressure acting on ink in the pressure generation chamber in accordance with displacement of, for example, a piezoelectric element has been known.

In some of the recording heads of such a type, a self-sealing unit and a head main body are integrally constituted (see JP-A-2012-166420, for example). In this case, the head main body means a member which includes both a flow path unit that forms a liquid flow path including a plurality of pressure generation chambers communicating with respective nozzles and a pressure generation unit that is constituted by, for example, a piezoelectric element generating change in the pressure of ink in the pressure generation chamber. In the self-sealing unit, a part of the liquid flow path is formed, for example, in such a manner that an opening of a concave portion formed in a lateral surface intersecting with a nozzle forming surface of the recording head is sealed by a film. Furthermore, a valve body is disposed in the middle of the liquid flow path. In a normal state, the valve body is biased to close the liquid flow path. When the inside of the liquid flow path sealed by the film is in the negative pressure state in accordance with ejection of ink, the valve body is pressed by the film displaced by the negative pressure and opens the liquid flow path.

Accordingly, when the negative pressure is generated, in accordance with ejection of the ink, in the liquid flow path sealed by the film, the film presses the valve body. Then, the valve body is opened by the pressing force and thus, the ink flows through the liquid flow path and is supplied to the pressure generation chamber.

In the recording apparatus of the related art, which includes the self-sealing unit as described above, a head unit is formed by making, into a unit, a plurality of recording heads in a state in which the recording heads are aligned in a direction perpendicular to a transporting direction of a printing medium. When the recording heads are made into a unit, the respective recording heads are arranged in a state where the central lines of upper surfaces of the respective self-sealing units, relative to the transporting direction, are set to be parallel to the transporting direction.

Meanwhile, in some case, the inclined arrangement of the self-sealing unit, relative to the transporting direction, is intended from, for example, the relationship in the layout in a substrate, relative to a flow path substrate connected to the self-sealing unit or a circuit substrate laminated on the flow path substrate. In this case, when the self-sealing unit of the related art is arranged to be simply inclined without any change, the size of the installation area of the self-sealing unit increases in the transporting direction. As a result, there is a problem in that an increase in the size of the recording apparatus is caused.

Such a problem is not limited to an ink jet type recording apparatus in which ink droplets are ejected but is shared by a liquid ejecting apparatus in which other liquid droplets are ejected.

SUMMARY

An advantage of some aspects of the invention is to provide a liquid ejecting apparatus capable of achieving a reasonable inclined arrangement in which, even when a self-sealing unit is arranged in an inclined state, an increase in the size of the liquid ejecting apparatus is not caused, a self-sealing unit, and a liquid ejecting head.

According to an aspect of the invention, there is provided a liquid ejecting apparatus which includes a transporting unit which transports a medium in a predetermined transporting direction, a liquid ejecting head main body which ejects liquid onto the medium, and a self-sealing unit which has a plurality of self-sealing valves in a state where film surfaces forming diaphragm portions face each other and cause the liquid to flow to the liquid ejecting head main body, in which the self-sealing valve opens/closes a flow path with a valve body which moves in accordance with displacement of the film surface and, when viewed from a liquid ejecting direction, the self-sealing unit is arranged in a state where a central line which is equidistant from the two film surfaces and perpendicular to the liquid ejecting direction, is inclined with respect to the transporting direction, a plurality of the valve bodies are spaced apart in the transporting direction, and both end surfaces of the self-sealing unit, which intersect with the transporting direction, are chamfered portions. The diaphragm portion acts as a diaphragm.

In this case, since the plurality of valve bodies are arranged to be spaced apart in the transporting direction of a medium, it is possible to reduce the size of the self-sealing unit in a direction other than the transporting direction. This can contribute to both a reduction in the size of the self-sealing unit and a reduction in the size of the liquid ejecting apparatus having the self-sealing unit mounted thereon. In addition, since both end surfaces of the self-sealing unit, which intersect with the transporting direction, are chamfered portions, this can also contribute to both a reduction in the size of the self-sealing unit and a reduction in the size of the liquid ejecting apparatus having the self-sealing unit mounted thereon.

In the liquid ejecting apparatus, it is preferable that, when viewed from the liquid ejecting direction, the self-sealing unit have a configuration in which, in an imaginary rectangle connecting intersection points at which the chamfered portions intersect with the two film surfaces, an angle on the valve body side is an obtuse angle and an angle on the diaphragm portion side is an acute angle. Accordingly, it is possible to ensure the film surface to have a large area, without an increase in the size of the self-sealing unit. As a result, it is possible to achieve a reduction in the size of the self-sealing unit, in a state where a large pressure receiving area of the film surface is ensured in the diaphragm portion. This can also contribute to both a reduction in the size of the self-sealing unit and a reduction in the size of the liquid ejecting apparatus having the self-sealing unit mounted thereon.

In the liquid ejecting apparatus, it is preferable that, when viewed from the liquid ejecting direction, the size of the self-sealing unit in the transporting direction be smaller than that in the central line. In this case, it is possible to more favorably reduce the size of the self-sealing unit in the transporting direction of a medium.

In the liquid ejecting apparatus, it is preferable that, when a plurality of the diaphragm portions are projected in a direction perpendicular to the central line, in a state where the diaphragm portions are viewed from the liquid ejecting direction, the diaphragm portions partially overlap. In this case, it is possible to arrange the diaphragm portions to be close to the central portion of the self-sealing unit, and thus it is possible to reduce the size of the self-sealing unit in the transporting direction.

In the liquid ejecting apparatus, it is preferable that the self-sealing unit discharge liquid which is supplied from one side in the liquid ejecting direction, to the other side through the diaphragm portion. In addition, it is preferable that an outlet portion through which the liquid flows out from the diaphragm portion be located further on the one side than the valve body. Furthermore, it is preferable that a flow path through which the fluid flows from the outlet portion to the other side be arranged in a portion between shafts of the plurality of valve bodies. In this case, the outlet portion of the diaphragm portion of the self-sealing unit is located on the one side of the diaphragm portion. Thus, when the one side is an upper side in a vertical direction, air bubbles in the diaphragm portion are likely to be gathered in the one side due to buoyancy, compared to a case in which the outlet portion is located on the other side. As a result, it is possible to improve air-discharge properties of the inside of the diaphragm portion. In addition, since the flow path through which fluid flows from the outlet portion to the other side is disposed in the portion between the shafts of the plurality of valve bodies, it is possible to reduce the size of the self-sealing unit in the transporting direction, compared to a case where the flow path is disposed outside the valve body.

It is preferable that the liquid ejecting apparatus further include a first member which is located further on one side in the liquid ejecting direction than the self-sealing unit and a second member which is located further on the other side than the self-sealing unit. In the liquid ejecting apparatus, it is preferable that the self-sealing unit be fixed in a state where the self-sealing unit is interposed between the first member and the second member. In this case, it is possible to reduce the size of the self-sealing unit in the transporting direction because it is not necessary to provide, for example, a flange to fix the self-sealing unit.

According to another aspect of the invention, there is provided a self-sealing unit which includes two film surfaces which face each other, two end surfaces which intersect with the two film surfaces, and a plurality of self-sealing valves, in which the self-sealing valve has a diaphragm portion which is formed by the film surface and a valve body which moves in accordance with displacement of the film surface and opens/closes a flow path and, when viewed from a direction perpendicular to a plane to which the self-sealing unit is fixed, among diagonal lines connecting intersection points between the two end surfaces and the two film surfaces, the length of a diagonal line connecting the intersection points on the diaphragm portion sides is longer than that of a diagonal line connecting the intersection points on the valve body sides.

In this case, among the diagonal lines connecting the intersection points between the two end surfaces and the two film surfaces of the self-sealing unit, the length of the diagonal line connecting the intersection points on the diaphragm portion sides is longer than that of the diagonal line connecting the intersection points on the valve body sides. Thus, it is possible to ensure the film surface of the diaphragm portion to have a large area, without an increase in the size of the self-sealing unit. As a result, it is also possible to achieve a reduction in the size of the self-sealing unit, in a state where a large pressure receiving area of the film surface is ensured in the diaphragm portion. The diaphragm portion acts as a diaphragm.

In the self-sealing unit, it is preferable that, when viewed from the direction perpendicular to the plane to which the self-sealing unit is fixed, the size, in at least one direction, between the two end surfaces be smaller than the size in a central line which is equidistant from the two film surfaces. In this case, when the self-sealing unit is mounted on the liquid ejecting apparatus, it is possible to reduce the size of the self-sealing unit in the transporting direction of a medium and this can contribute to a reduction in the size of the liquid ejecting apparatus.

In the self-sealing unit, it is preferable that, when a plurality of the diaphragm portions are projected in a direction perpendicular to the central line, in a state where the diaphragms are viewed from the direction perpendicular to the plane to which the self-sealing unit is fixed, the diaphragm portions partially overlap. In this case, a reduction in the size of the self-sealing unit is achieved in the central line direction and, furthermore, this can also contribute to a reduction in the size of the liquid ejecting apparatus having the self-sealing unit mounted thereon.

It is preferable that the self-sealing unit discharge liquid which is supplied from one side in the direction perpendicular to the plane to which the self-sealing unit is fixed, to the other side through the diaphragm portion. In addition, it is preferable that an outlet portion through which the liquid flows out from the diaphragm portion be located further on the one side than the valve body. Furthermore, it is preferable that a flow path through which the fluid flows from the outlet portion to the other side be arranged in a portion between shafts of a plurality of the valve bodies. In this case, the outlet portion of the diaphragm portion of the self-sealing unit is located on the one side of the diaphragm portion. Thus, when the one side is the upper side in the vertical direction, air bubbles in the diaphragm portion are likely to be gathered in the one side due to buoyancy, compared to a case in which the outlet portion is located on the other side. As a result, it is possible to improve air-discharge properties of the inside of the diaphragm portion. In addition, since the flow path through which fluid flows from the outlet portion to the other side is disposed in the portion between the shafts of the plurality of valve bodies, it is possible to reduce the size of the self-sealing unit in the transporting direction, compared to a case where the flow path is disposed outside the valve body.

In the self-sealing unit, it is preferable that the self-sealing unit be fixed in a state where the self-sealing unit is interposed between a first member which is located further on one side than the self-sealing unit in the direction perpendicular to the plane to which the self-sealing unit is fixed and a second member which is located further on the other side than the self-sealing unit. In this case, it is possible to reduce the size of the self-sealing unit because it is not necessary to provide, for example, a flange to fix the self-sealing unit.

According to still another aspect of the invention, there is provided a liquid ejecting head which includes a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber, and the self-sealing unit of the above-described aspect which supplies the liquid into the pressure generation chamber in such a manner that negative pressure acts on the diaphragm portion of the self-sealing unit of the above-described aspect in accordance with ejection of the liquid through the nozzles and the self-sealing valve is opened in accordance with action of the negative pressure.

In this case, the liquid ejecting head is configured in combination with the self-sealing unit of the aspects. Thus, when the head unit is arranged in an inclined state, it is possible to achieve the same effects as those in the aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the details of embodiments of the invention will be described with reference to the accompanying drawings.

An ink jet type recording apparatus as an example of a liquid ejecting apparatus according to the embodiment is a so-called line type recording apparatus in which printing is performed in such a manner that an ink jet type recording head unit as a liquid ejecting head unit is fixed and a recording sheet, such as a paper sheet, as an ejecting target medium is transported.

Figure 1:
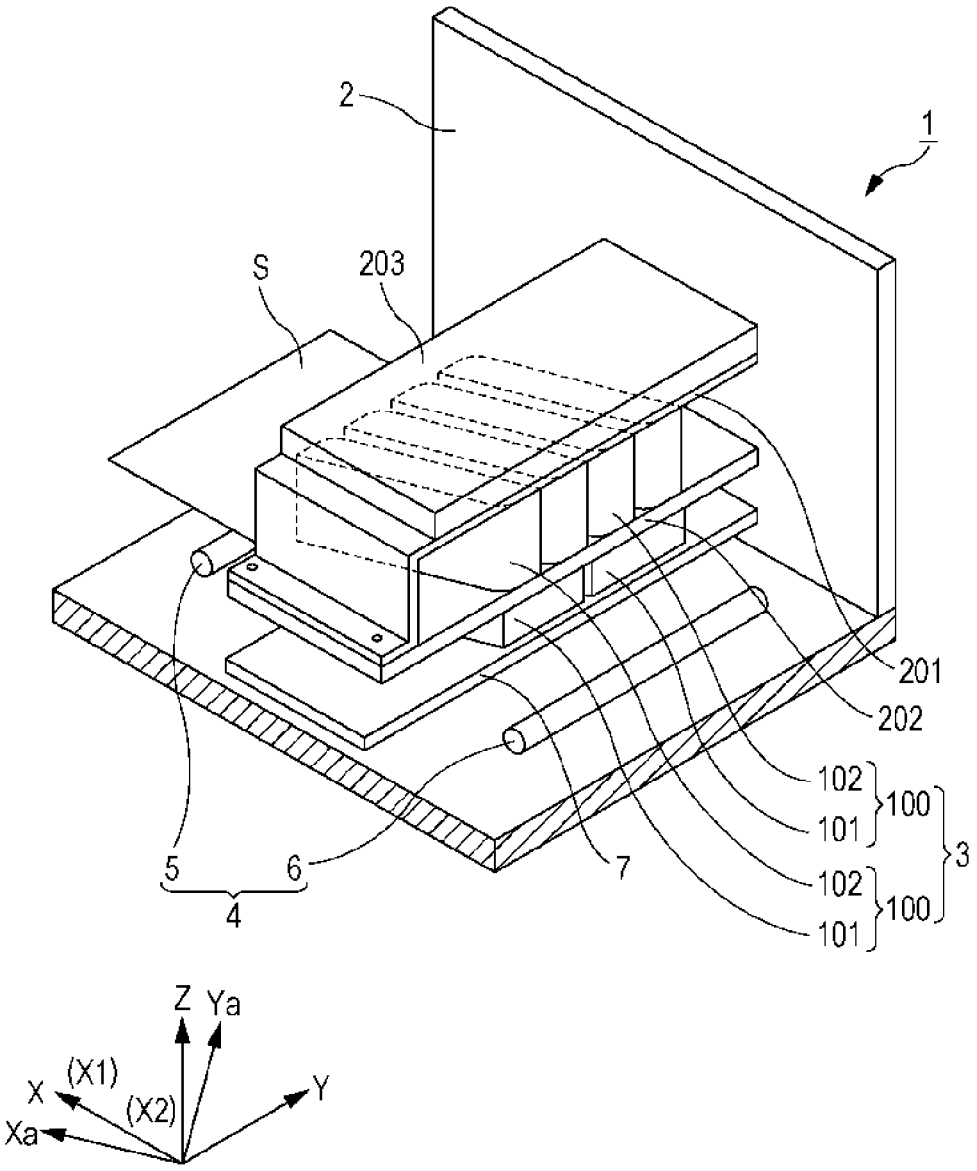
FIG. 1 is a schematic perspective view illustrating a recording apparatus according to an embodiment of the invention.

Specifically, an ink jet type recording apparatus 1 (hereinafter, also referred to simply as the recording apparatus 1) includes an apparatus main body 2, an ink jet type recording head unit 3 (hereinafter, also referred to simply as the head unit 3) which includes a plurality of ink jet type recording heads 100 (hereinafter, also referred to simply as the recording heads 100) and is fixed to the apparatus main body 2, a transporting unit 4 which transports a recording sheet S, such as a paper sheet, as a recording medium, and a support member 7 which supports a back surface of the recording sheet S, which is a surface opposite to a print surface facing the head unit 3, as illustrated in FIG. 1 which is a schematic perspective view of a recording apparatus of the embodiment.

A first direction X of the embodiment is parallel to a transporting direction of the recording sheet S and a second direction Y is parallel to a direction perpendicular to the first direction X in an in-plane direction in which a self-sealing unit 102 is fixed. A third direction Z is parallel to a direction perpendicular to both the first direction X and the second direction Y. In addition, a fourth direction Xa intersecting with the first direction X in the in-plane direction in which the self-sealing unit 102 is fixed and is parallel to the longitudinal direction of the self-sealing unit 102. A fifth direction Ya is parallel to a direction perpendicular to the fourth direction Xa in the in-plane direction in which the self-sealing unit 102 is fixed. Furthermore, the fourth direction Xa is not parallel to the second direction Y. In this case, the recording sheet S is transported from an X1 side to an X2 side in the first direction X. The details of these will be described below.

The head unit 3 in the embodiment is constituted by arranging the plurality of recording heads 100 in the second direction Y. Furthermore, the recording head 100 is constituted by integrally assembling a head main body 101 and the self-sealing unit 102.

Although not illustrated, the head main body 101 includes a flow path unit, a pressure generation unit, and the like. The flow path unit forms a liquid flow path which includes a plurality of pressure generation chambers communicating with nozzles. The pressure generation unit is constituted by, for example, a piezoelectric element which generates change in pressure of ink in the pressure generation chamber. The head main body 101 is installed in a fixing substrate 202, in a state where the head main body 101 protrudes downward, from a lower surface of the fixing substrate 202. The self-sealing unit 102 is interposed between the fixing substrates 201, 202, in a state where a lower surface of the self-sealing unit 102 abuts on an upper surface of the fixing substrate 202 and an upper surface of the self-sealing unit 102 abuts on a lower surface of the fixing substrate 201.

Furthermore, although the details of the self-sealing unit 102 will be described below, the self-sealing unit 102 has a configuration as described below. A valve body is provided in the middle of the liquid flow path. The liquid flow path is formed by sealing, using the film, an opening of a concave portion provided in a lateral surface intersecting with a surface to which the self-sealing unit 102 is fixed. When the inside of the liquid flow path is in a normal state, the valve body is biased to close the liquid flow path. When the inside of the liquid flow path sealed by the film is in a negative pressure state in accordance with ejection of ink, the valve body in a state where the valve body is pressed by the film displaced by the negative pressure opens the liquid flow path. Accordingly, when a negative pressure is generated in the pressure generation chamber, in accordance with ejection of ink, the film presses the valve body. As a result, the valve body is opened by the pressing force, and thus ink flows through the liquid flow path and is supplied to the pressure generation chamber.

Figure 2:
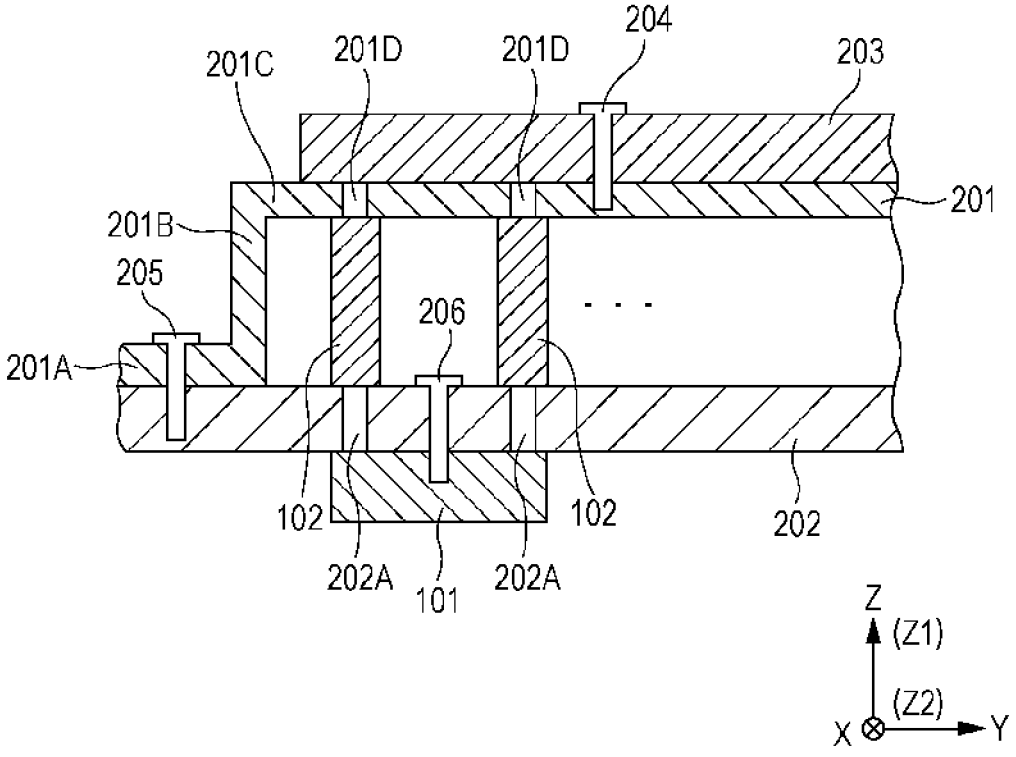
FIG. 2 is an explanatory view which schematically illustrates an aspect of the fixation of a self-sealing unit.

An aspect of the fixation of the self-sealing unit 102 will be described referring to FIG. 2. FIG. 2 is an explanatory cross-sectional view which schematically illustrates the aspect of the fixation of the self-sealing unit 102, when seen from the first direction X. Although, the fourth direction Xa which is the longitudinal direction of the self-sealing unit 102 intersects with the first direction X, a part of the lateral surface of the self-sealing unit 102 is not illustrated in FIG. 2. The self-sealing unit 102 is interposed between the fixing substrates 201, 202, in a state where the self-sealing unit 102 abuts on the lower surface of the fixing substrate 201 which is a first substrate and abuts on the upper surface of the fixing substrate 202 which is a second substrate, as illustrated in FIG. 2. In this case, the fixing substrate 201 is constituted by a flange portion 201A, a vertical wall portion 201B, and a fixing portion 201C. The flange portion 201A abuts on the upper surface of the fixing substrate 202, which is an horizontal surface, and horizontally extends. The vertical wall portion 201B vertically rises from the flange portion 201A. The fixing portion 201C horizontally extends from an upper end of the vertical wall portion 201B. Accordingly, a space is formed in a portion between the upper surface of the fixing substrate 202 and the lower surface of the fixing substrate 201, in such a manner that the fixing substrate 201 is fixed to the upper surface of the fixing substrate 202 through the flange portion 201A using a fastener member 205. The self-sealing unit 102 is installed in the space between the upper surface of the fixing substrate 202 and the lower surface of the fixing substrate 201 and the self-sealing unit 102 is interposed between the fixing substrate 201 and the fixing substrate 202. In the embodiment, a surface to which the self-sealing unit 102 is fixed is either the upper surface of the fixing substrate 202 or the lower surface of the fixing substrate 201. However, for convenience of the description, it is assumed that the surface to which the self-sealing unit 102 is fixed is set to the upper surface of the fixing substrate 202. In addition, regarding the self-sealing unit 102, a surface side through which the self-sealing unit 102 is fixed is set to a Z2 side and the opposite side is set to a Z1 side in the third direction Z.

In the example, a common flow path member 203 is disposed on the upper surface of the fixing substrate 201 and the common flow path member 203 causes the ink supplied from an ink receiving portion (not illustrated), such as a cartridge, to be distributed to each self-sealing unit 102 through flow paths 201D. The common flow path member 203 is fixed to the fixing substrate 201 using a fastener member 204.

As described above, in the embodiment, the fixing substrates 201, 202 which fix the self-sealing unit 102 in a pinching manner are fixed using a fastener member 205 which is located, in the second direction Y, relative to the self-sealing unit 102. Accordingly, it is not necessary to form, in the self-sealing unit 102, flange portions for fixing which are formed in the related art, in a state where the flange portions for fixing protrude from both ends of the self-sealing unit 102 in the longitudinal direction (the first direction X in FIG. 2). In addition, the size of the self-sealing unit 102 in the longitudinal direction can be reduced by as much as the size of the flange portion in the longitudinal direction.

The head main body 101 is disposed in a state where the head main body 101 abuts on the lower surface of the fixing substrate 202. Ink is supplied from the self-sealing unit 102, through a flow path 202A formed in the fixing substrate 202. The head main body 101 is fixed to the fixing substrate 202 using a fastener member 206.

In the embodiment, the respective end portions of the fixing substrate 201 and the fixing substrate 202 which pinch the self-sealing unit 102 are fixed to the apparatus main body 2.

The transporting unit 4 transports a recording sheet S from an upstream side which is the X1 side in the first direction X to a downstream side which is the X2 side, relative to the head unit 3. The transporting unit 4 includes a first transporting roller 5 and a second transporting roller 6 which are disposed on both sides of the head unit 3 in the first direction X which is the transporting direction of the recording sheet S. The transporting unit 4 transports the recording sheet S using both the first transporting roller 5 and the second transporting roller 6. The transporting unit 4 for transporting the recording sheet S is not limited to a transporting roller and may be a belt, a drum, or the like.

The support member 7 supports the recording sheet S transported by the transporting unit 4, in a position facing the head unit 3. The support member 7 is constituted by, for example, metal or resin of which the surface facing a nozzle surface of the head unit 3, particularly, of the head main body 101, in a portion between the first transporting roller 5 and the second transporting roller 6, has a rectangular shape.

An attracting unit that performs attraction of the transported recording sheet S on the support member 7 may be provided in the support member 7. Examples of the attracting unit include a unit which suctionally attracts the recording sheet S in a sucking manner and a unit which electrostatically attracts the recording sheet S using an electrostatic force.

In the recording apparatus 1, the recording sheet S is transported by the first transporting roller 5 and printing is performed on the recording sheet S supported on the support member 7 by the head unit 3. The recording sheet S subjected to printing is transported by the second transporting roller 6.

Figure 3A:
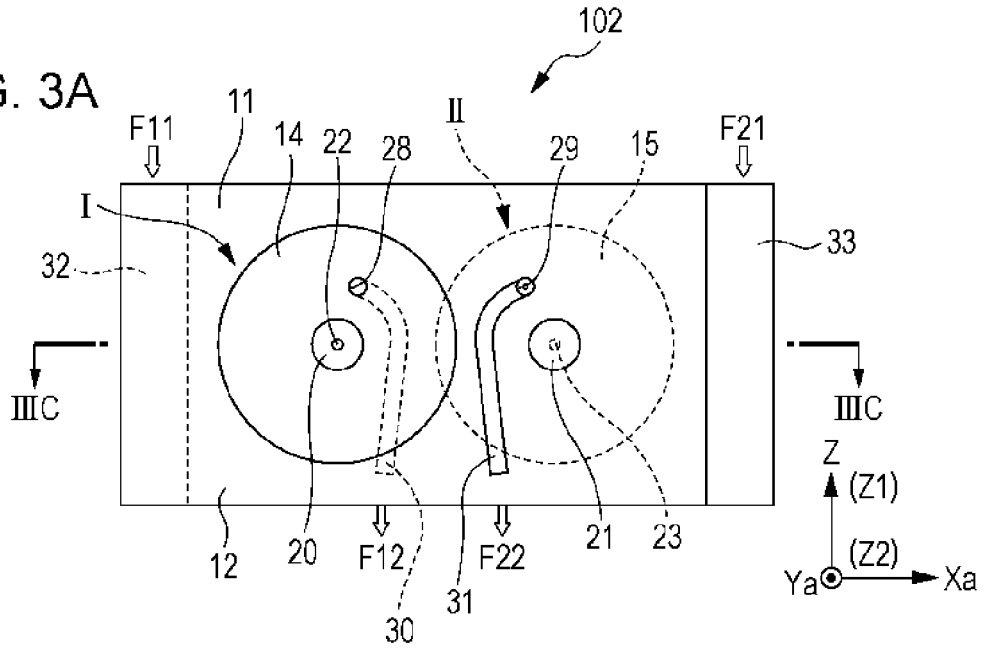
FIGS. 3A to 3C are schematic configuration views which illustrate the self-sealing unit alone.
Figure 3B:
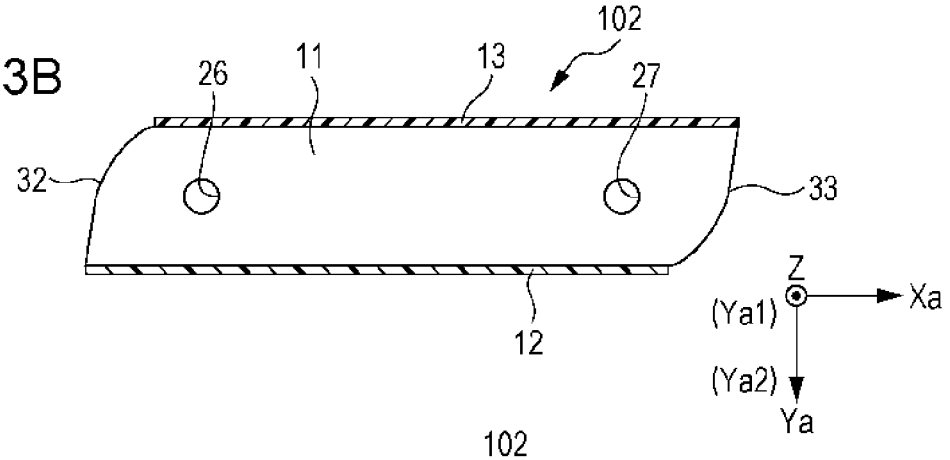
Figure 3C:
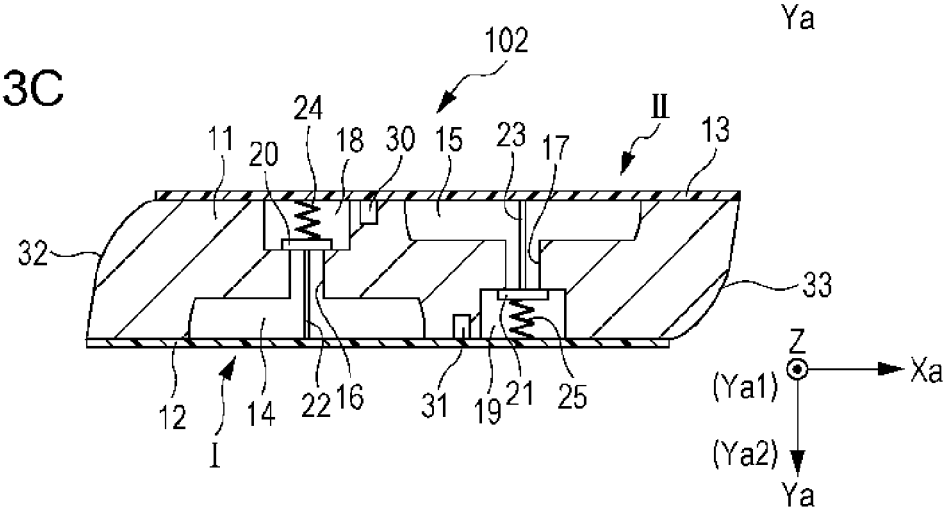

FIG. 3A is a schematic configuration view in which the self-sealing unit of the embodiment is viewed from the fifth direction Ya and FIG. 3B is a schematic configuration view in which the self-sealing unit of the embodiment is viewed from the Z1 side in the third direction Z. FIG. 3C is a schematic configuration view illustrating the cross-sectional surface taken along line IIIC-IIIC in FIG. 3A. The self-sealing unit 102 is a member of which the entirety of the outward appearance has a substantially rectangular shape and films 12, 13 are adhered to both surfaces of the lateral surface of a main body 11 in the longitudinal direction, as illustrated in FIGS. 3A to 3C. In other words, the self-sealing unit 102 has two film surfaces which extend in the fourth direction Xa and face each other in the fifth direction Ya.

Meanwhile, in two facing surfaces of the main body 11 in the fifth direction Ya, a concave portion (see FIG. 3C) is formed on one surface, on a left side (a one side) in the fourth direction Xa in FIG. 3C and a similar concave portion (see FIG. 3C) is also formed on the other surface, on a right side (the other side) in the fourth direction Xa in FIG. 3C. The concave portions are spaces sealed by the films 12, 13. As a result, the films 12, 13 are displaced in the fifth direction Ya, in accordance with change in the pressure in the space. In other words, diaphragm chambers 14, 15 are constituted by the films 12, 13 and the concave portions. Valve chambers 18, 19 which are concave portions smaller than the concave portions and are sealed by the films 12, 13 are formed, with communication holes 16, 17 interposed therebetween, on surface sides opposite to the diaphragm chambers 14, 15.

The other end of a shaft 22 passing through the communication hole 16 is fixed to a valve body 20. One end of the shaft 22 is fixed to the film 12 via, for example, a pressure receiving plate (not illustrated). In other words, the valve body 20 is located on a side opposite to the film 12, relative to the communication hole 16. In the embodiment, the valve body 20 side with respect to the communication hole 16 is set to a Ya1 side in the fifth direction Ya and the film 12 side with respect to the communication hole 16 is set to a Ya2 side in the fifth direction Ya. Furthermore, the valve body 20 is pressed, by a spring 24, from the Ya1 side to the Ya2 side. The valve body 20 opens or closes the communication hole 16, in accordance with both displacement of the film 12 and biasing by the spring 24. The spring 24 is fixed to the main body 11, through, for example, a spring receiving portion (not illustrated).

Similarly, the other end of a shaft 23 passing through the communication hole 17 is fixed to a valve body 21. One end of the shaft 23 is fixed to the film 13 via, for example, a pressure receiving plate (not illustrated). In other words, the valve body 21 is located on a side opposite to the film 13, relative to the communication hole 17. The valve body 21 is pressed, by a spring 25, from the Ya2 side to the Ya1 side. The valve body 21 opens or closes the communication hole 17, in accordance with both displacement of the film 13 and biasing by the spring 25. The spring 25 is fixed to the main body 11, through, for example, a spring receiving portion (not illustrated). The adjacent valve body 20 and the valve body 21 in the fourth direction Xa are located on both sides in the fifth direction Ya, relative to the communication holes 16, 17 thereof.

Accordingly, when negative pressure acts on the diaphragm chambers 14, 15, parts of the films 12, 13, which are portions corresponding to the diaphragm chambers 14, 15, are displaced in the fifth direction Ya by atmospheric pressure and the like. As a result, the valve body 20 moves to the Ya1 side in FIG. 3C and the valve body 21 moves to the Ya2 side in FIG. 3C, and thus the valve bodies 20, 21 open the communication holes 16, 17. In this case, it is possible to configure the diaphragm chambers 14, 15 so that negative pressure in the head main body 101, which is caused by the ejection of ink through the nozzles by the head main body 101, acts on the diaphragm chambers 14, 15. The films 12, 13 of the diaphragm chambers 14, 15 function as a diaphragm portion.

Accordingly, the self-sealing unit 102 of the embodiment has a self-sealing valve I and a self-sealing valve II. The self-sealing valve I is constituted by the film 12, the diaphragm chamber 14, the valve body 20, the shaft 22, and the spring 24. The self-sealing valve II is constituted by the film 13, the diaphragm chamber 15, the valve body 21, the shaft 23, and the spring 25. In this case, the self-sealing valves I, II are arranged to be spaced from each other in the fourth direction Xa. Accordingly, it is configured so that the shafts 22, 23 of the valve bodies 20, 21 are prevented from overlapping in the third direction Z, and thus the size of the self-sealing unit 102 is reduced in the third direction Z. Furthermore, since the fourth direction Xa intersects with the first direction X, it is also possible to say that the self-sealing valves I, II are arranged to be spaced from each other in the first direction X.

Both an ink supply port 26 which supplies ink to the self-sealing valve I side and an ink supply port 27 which supplies ink to the self-sealing valve II side are formed on the upper surface of the main body 11, which is located on the Z1 side in the third direction Z. The ink supply ports 26, 27 communicate with the flow path inside the main body 11. Accordingly, a flow-in ink F11 which flows into the self-sealing valve I side through the ink supply port 26 is supplied, as a flow-out ink F12, from the lower surface formed on the Z2 side of the main body 11 to the head main body 101. In addition, a flow-in ink F21 which flows into the self-sealing valve II side through the ink supply port 27 is supplied, as a flow-out ink F22, from the lower surface of the main body 11 to the head main body 101. More specifically, the ink supplied through the ink supply port 26 flows in the fifth direction Ya and flows from the film 13 side to the valve chamber 18. In the state described above, when negative pressure acts on the diaphragm chamber 14, and thus the valve body 20 opens the valve in accordance with displacement of the film 12, this causes the ink to flow into the diaphragm chamber 14. Then, the ink is introduced into a flow path 30 of which an outlet portion 28 faces the diaphragm chamber 14 and flows downward on a rear surface side of the main body 11. Subsequently, the ink is supplied, as the flow-out ink F12, to the head main body 101 through a discharge port (not illustrated) on the lower surface of the main body 11.

Meanwhile, the ink supplied through the ink supply port 27 flows in the fifth direction Ya and flows from the film 12 side to the valve chamber 19. In the state described above, when negative pressure acts on the diaphragm chamber 15, and thus the valve body 21 opens the valve in accordance with displacement of the film 13, this causes the ink to flow into the diaphragm chamber 15. Then, the ink is introduced into a flow path 31 of which an outlet portion 29 faces the diaphragm chamber 15 and flows downward on a front surface side of the main body 11. Subsequently, the ink is supplied, as the flow-out ink F22, to the head main body 101 through a discharge port (not illustrated) on the lower surface of the main body 11.

Furthermore, in the embodiment, the configuration is devised so that, when a plurality of the self-sealing units 102 are installed, a space occupied by the self-sealing units 102 can be reduced as much as possible, in such a manner that chamfered portions 32, 33 are formed on both end surfaces of the main body 11 in the fourth direction Xa in FIGS. 3A to 3C. The details of this point will be described below.

Both the flow paths 30, 31 in the self-sealing valves I, II are arranged in a portion between the adjacent shafts 22, 23 of the self-sealing valves I, II. As a result, it is possible to reduce the size of the self-sealing unit 102 in the fourth direction Xa, compared to in a case where the flow paths 30, 31 are arranged further in both end surface sides of the main body 11 in the fourth direction Xa than the shafts 22, 23. In addition, the configuration is devised so that, when forming the chamfered portions 32, 33 in end surfaces of the main body 11 in the fourth direction Xa, and when a plurality of the self-sealing units 102 are installed, a space occupied by the self-sealing units 102 can be reduced, as much as possible, in a state where the positions of the flow paths 30, 31 do not obstruct forming of the chamfered portions, in such a manner that both the flow paths 30, 31 are arranged in a portion between the shafts 22, 23. The details of this point will be described below.

The self-sealing valves I, II of the embodiment are formed in a shape in which parts of the diaphragm chambers 14, 15 overlap with each other, in a perspective view from the fifth direction Ya, as illustrated in FIG. 3A. Accordingly, since parts of the diaphragm portions 14, 15 overlap with each other, it is possible to arrange the self-sealing valves I, II to be close to the central portion of the main body 11 in the fourth direction Xa. As a result, it is possible to reduce the size of the self-sealing unit 102 in the fourth direction Xa and it is possible to easily form the chamfered portions 32, 33.

In the self-sealing unit in the embodiment, the ink supplied from the upper surface on an upper side in a vertical direction, that is, the Z1 side in the third direction Z passes through the diaphragm chambers 14, 15 performing a self-sealing valve function, and then the ink is discharged, toward the head main body 101, from the lower surface on a lower side in the vertical direction, that is, the Z2 side in the third direction Z. In other words, in the self-sealing unit 102 of the embodiment, the ink (the liquid) flowing from one side, that is, the Z1 side, is discharged through the self-sealing valves I, II, from the other side, that is, the Z2 side. In this case, the discharging direction of ink is parallel to the third direction Z.

Figure 4A:
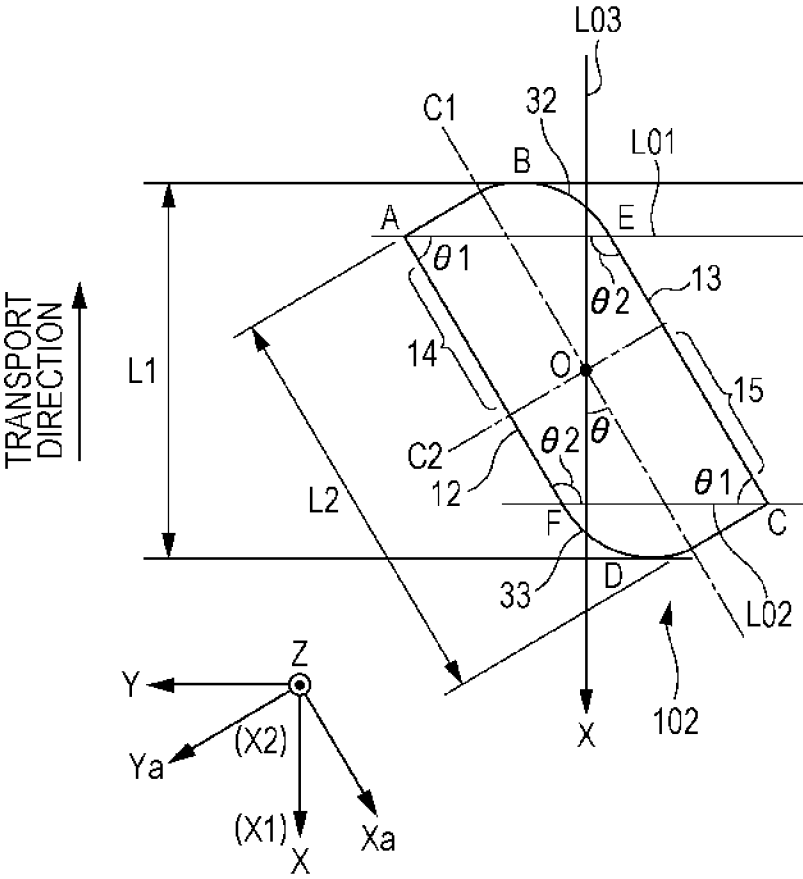
FIGS. 4A and 4B are explanatory views in which the arrangement of the self-sealing unit is illustrated in comparison with another comparative example.
Figure 4B:
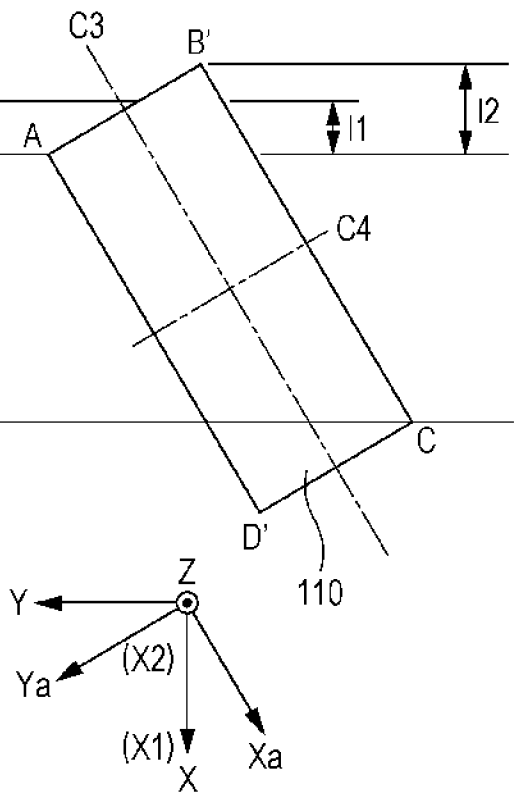

FIGS. 4A and 4B are explanatory views in which the arrangement of the self-sealing unit is illustrated in comparison with another comparative example. Specifically, FIGS. 4A and 4B illustrate the relationship between the self-sealing unit 102 having the chamfered portions 32, 33 and the transporting direction as the first direction X. As illustrated in FIG. 4A, in the self-sealing unit 102 of the embodiment, the surfaces formed by the two films 12, 13 in a facing state adhere to lateral surfaces of the main body 11, as described above. When the self-sealing unit 102 is viewed from the third direction Z, a central line C1 of the self-sealing unit 102, which is equidistant from both films 12, 13, is inclined at an angle θ, relative to the first direction X, that is, the transporting direction of the recording sheet S in the recording apparatus 1 on which the self-sealing unit 102 is mounted. In this case, the fourth direction Xa is parallel to the direction of the central line C1. In other words, the angle θ indicates an angle between the fourth direction Xa and the first direction X. Furthermore, in the embodiment, the surfaces formed by the films 12, 13 are parallel to each other.

In this case, the main body 11 of the self-sealing unit 102 according to the embodiment has the chamfered portion 32 and the chamfered portion 33, both of which intersect with the surfaces of the films 12, 13. The chamfered portion 32 is an end surface on one side in the first direction X and the chamfered portion 33 is an end surface on the other side. In other words, the self-sealing unit 102 is fixed in a state where both the chamfered portion 32 and the chamfered portion 33 intersects with the transporting direction (a direction directed from the X1 side to the X2 side: hereinafter, the transporting direction refers to the same direction) as the first direction X.

When the self-sealing unit 102 is viewed from the third direction Z in the FIG. 4A, an intersection point between the film 12 and the chamfered portion 32 is set to a point A and an intersection point between the film 13 and the chamfered portion 33 is set to a point C. In addition, an intersection point between the film 13 and the chamfered portion 32 is set to a point E and an intersection point between the film 12 and the chamfered portion 33 is set to a point F. When a focus is placed on the film 12, the chamfered portion 32 is located on the diaphragm chamber 14 side and the chamfered portion 33 is located on the valve body 21 side.

A self-sealing unit 110 which is formed in a rectangular shape and does not have the chamfered portions 32, 33 in FIG. 4A is illustrated in FIG. 4B. In the self-sealing units 102, 110, the positions of the points A, C in the self-sealing unit 102 is similar to those of the self-sealing unit 110, relative to the first direction X. The size (the size in the fourth direction Xa) of the self-sealing unit 102 in the central line C1 is the same as the size of the self-sealing unit 110 in a central line C3 and the size (the size in the fifth direction Ya) of the self-sealing unit 102 in a central line C2 is the same as the size of the self-sealing unit 110 in a central line C4. In addition, the central line C3 is inclined at the angle θ relative to the first direction X, similarly to the case of the central line C1. The central line C3 is a straight line corresponding to the central line C1 and the central line C4 is a straight line corresponding to the central line C2. In addition, the central line C2 is perpendicular to the central line C1 and the central line C4 is perpendicular to the central line C3. Each of the central lines C1, C2 is a line equidistant from the points A, C in the self-sealing unit 102 and each of the central lines C3, C4 is a line equidistant from the points A, C in the self-sealing unit 110. In addition, the point B is a point on the chamfered portion 32 and, also, is a point located on the farthest one side in the first direction X. The point D is a point on the chamfered portion 33 and is a point located on the farthest other side in the first direction X (see FIG. 4A). In FIG. 4B, a point B' is an intersection point between a straight line which passes through the point A and is parallel to the central line C4 and a straight line which passes through the point C and is parallel to the central line C3. A point D' is an intersection point between a straight line which passes through the point A and is parallel to the central line C3 and a straight line which passes through the point C and is parallel to the central line C4.

In the first direction X, the positions of the points A, C in the self-sealing unit 102 is similar to those in the self-sealing unit 110, as illustrated in FIGS. 4A and 4B. However, the points B', D' in the self-sealing unit 110, which correspond to the points B, D in the self-sealing unit 102, are located further outside in the first direction X than the points B, D in the self-sealing unit 102. In other words, since the chamfered portions 32, 33 are formed in the self-sealing unit 102 and the self-sealing unit 102 is fixed in a state where the chamfered portions 32, 33 intersect with the first direction X, it is possible to reduce the size of an area in the first direction X, which is the area necessary to fix the self-sealing unit 102. In other words, when it is assumed that the rectangle AD'CB' corresponding to the self-sealing unit 102 is arranged in a state where the central line C3 thereof intersects with the first direction X, similarly to the central line C1 of the self-sealing unit 102, the lateral surfaces of the self-sealing unit 110 is configured so that the size of the self-sealing unit 102 in the first direction X is smaller than the size of the rectangle AD'CB' in the first direction X. Accordingly, it is possible to reduce the size of the area in the first direction X, which is the area necessary to fix the self-sealing unit 102.

In the embodiment, the chamfered portions 32, 33 are formed such that a distance L1 which is the size of the self-sealing unit 102 in the first direction X is shorter than a distance L2 which is the size of the self-sealing unit 102 in the fourth direction Xa. Accordingly, it is possible to further reduce the size of the self-sealing unit 102 in the first direction X. As a result, it is possible to further reduce the installation space of the self-sealing unit 102 in the first direction X. The distance L1 is given as a distance between the point B and the point D, both of which are projected onto a third imaginary line L03 parallel to the first direction X. The third imaginary line L03 is parallel to the first direction X, and thus, when the distance on the third imaginary line L03 is reduced, the size of the self-sealing unit 102 in the first direction X is reduced.

Furthermore, when it is attempted to reduce the size of the recording apparatus 1, in such a manner that the size in the transporting direction is reduced, both end surfaces intersecting with the surfaces of the films 12, 13 in both the upstream side and the downstream side in the transporting direction parallel to the first direction X may be chamfered. However, in a case where the transporting direction is directed upward (that is, directed from the X1 side to the X2 side) in FIGS. 4A and 4B, when it is configured so that the relationship between a distance l1 which is a distance between, in the first direction X, the point B, that is, the foremost point of the self-sealing unit 102 in the first direction X and the point A and a distance 12 which is a distance between, in the first direction X, the point B', that is, the foremost point of the self-sealing unit 110, and the point A satisfies $l1<(1/2)\times l2$, a reduction in the size of the self-sealing unit 102 in the first direction X is favorably achieved in a case where the self-sealing unit 102 is arranged in an inclined state. This effectively contributes to a reduction in the size of the apparatus. In the relationship of $l1<(1/2)\times l2$, the minimum value of l1 is obtained in a case where the position of the point B and the position of the point A are the same in the first direction X. When the condition described above is satisfied, the transporting-directional (the first direction X) size of the self-sealing unit 102 arranged in an inclined state can be reduced to the utmost.

Figure 5A:
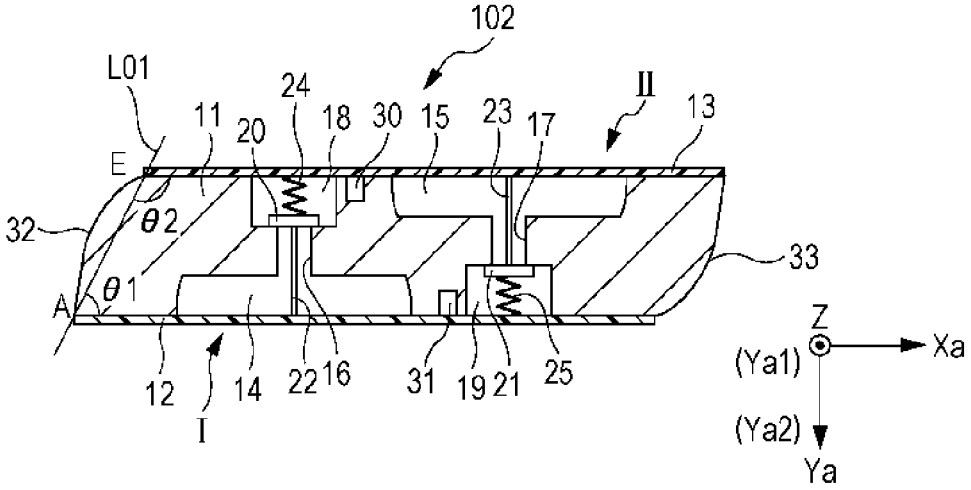
FIGS. 5A and 5B are explanatory views which illustrate the self-sealing unit alone in comparison with another comparative example.
Figure 5B:
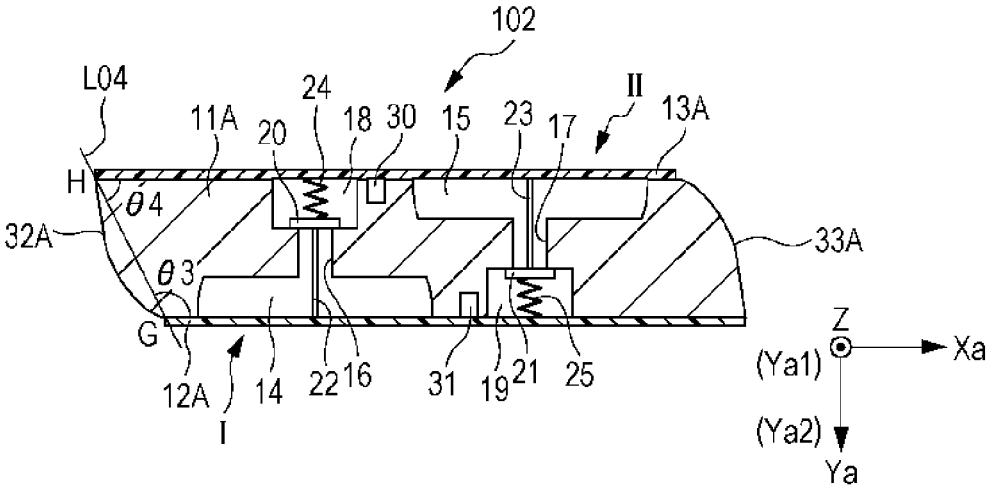

FIGS. 5A and 5B illustrate a configuration of the self-sealing unit and a schematic configuration view of a comparative example, using the same schematic configuration view as that in FIG. 3C to explain the relationship between a chamfered portion and a self-sealing valve in the self-sealing unit, in a case where the chamfered portion is formed on a main body of the self-sealing unit. In other words, the configuration in FIG. 5A is the same as that of the self-sealing unit illustrated in FIG. 3C. In addition, the configuration in FIG. 5A is also the same as that of the self-sealing unit illustrated in FIG. 4A.

In the embodiment, it is configured so that an angle θ1 (that is, an angle between a second imaginary line L02 and a side CE on the surface of the film 13) between a first imaginary line L01 and a side AF on the surface of the film 12 is an acute angle and an angle θ2 (that is, an angle between the second imaginary line L02 and the side AF on the surface of the film 12) between the first imaginary line L01 and the side CE on the surface of the film 13 is an obtuse angle, as illustrated in FIGS. 4A and 5A.

In contrast, in a self-sealing unit illustrated in FIG. 5B in which the same reference numerals are given to components having the same configurations as those in FIG. 5A, portions, such as the diaphragm chambers 14, 15 and the valve bodies 20, 21, functioning as the self-sealing valves I, II have the same configuration, including the size of each portion, as those in FIG. 5A. However, the shapes of chamfered portions 32A, 33A of a main body 11A in the fourth direction Xa are different from those in FIG. 5A. In other words, in a point G which is an intersection point, on the diaphragm chamber 14 side, between the surface of a film 12A corresponding to the surface of the film 12 in FIG. 5A and a fourth imaginary line L04 corresponding to the first imaginary line L01, an angle θ3 is an obtuse angle. In addition, in a point H which is an intersection point, on the valve body 20 side, between the surface of a film 13A corresponding to the surface of the film 13 in FIG. 5A and a fourth imaginary line L04 corresponding to the first imaginary line L01, an angle θ4 is an acute angle. Thus, when it is necessary to achieve the same function of the self-sealing valves I, II without change in the pressure receiving area of the diaphragm chamber 14, the size of the main body 11A in the fourth direction Xa is greater than that of the main body 11 illustrated in FIG. 5A. Accordingly, the size of the films 12A, 13A also increase, and thus, despite no change in the function of the self-sealing valves I, II, the whole size of the self-sealing unit 102 increases. In other words, since the angle θ1 is set to an acute angle and the angle θ2 is set to an obtuse angle, as illustrated in FIG. 5A, it is possible to achieve a reduction in the size of a self-sealing unit.

Accordingly, in the embodiment, among the points A, E, C, and F which are the intersection points between both end surfaces of the self-sealing unit 102, which intersect with the transporting direction (the first direction X), and the surfaces of the films 12, 13, the angle θ1 of an angle EAF in which the point A which is an intersection point on the diaphragm chamber 14 side is a vertex can be an acute angle and the angle θ1 of an angle ECF in which the point C which is an intersection point on the diaphragm chamber 15 side is a vertex can be an acute angle. In addition, the angle θ2 of an angle AEC in which the point E which is an intersection point on the valve body side is a vertex can be an obtuse angle and the angle θ2 of an angle AFC in which the point F which is an intersection point on the valve body side is a vertex can be an obtuse angle. Accordingly, it is possible to ensure the diaphragm portions of the films 12, 13 to have a large area, without an increase in the size of the self-sealing unit 102. As a result, it is possible to achieve a reduction in the size of the self-sealing unit 102, in a state where a large pressure receiving area of the films 12, 13 is ensured in the diaphragm chambers 14, 15. This also can contribute to a reduction in the size of the self-sealing unit 102.

In other words, in the rectangle AFCE corresponding to the self-sealing unit 102, when the length of a diagonal line AC connecting the intersection point A on the diaphragm chamber 14 side and the intersection point C on the diaphragm chamber 15 side is longer than the length of a diagonal line EF connecting the intersection point E on the valve body 20 side and the intersection point F on the valve body 21 side, this can contribute to a reduction in the size of the self-sealing unit 102, in a state where the diaphragm chambers 14, 15 having a relatively large pressure receiving area are formed.

In the embodiment described above, ink is supplied to the self-sealing unit 102 through the common flow path member 203. However, the configuration is not limited thereto. It may be configured so that the self-sealing unit 102 is interposed between the fixing substrates 201, 202 and ink is directly supplied from a receiving portion to the self-sealing unit 102 through, for example, a tube.

In the embodiment described above, a so-called line type recording apparatus in which printing is performed in such a manner that the head unit 3 is fixed to the apparatus main body 2 and the recording sheet S is transported is exemplified as the ink jet type recording apparatus 1. However, without being particularly limited thereto, the invention can also be applied to a so-called serial type recording apparatus in which printing is performed in such a manner that the head unit 3 is mounted on a carriage moving in a direction, for example, the second direction Y, intersecting with the first direction X which is the transporting direction of the recording sheet S and the head unit 3 is moved in the direction intersecting with the transporting direction.

In the embodiment described above, the size of the self-sealing unit 102 in the transporting direction is reduced in such a manner that the first direction X is set to be parallel to the transporting direction and, among the end surfaces of the self-sealing unit 102, the chamfered portions 32, 33 are formed in the end surfaces intersecting with the first direction X and this contributes to a reduction in the size of an apparatus. However, the configuration is not limited thereto. In other words, when the self-sealing unit 102 is viewed from a direction perpendicular to a plane to which the self-sealing unit 102 is fixed, when the size of the self-sealing unit 102 in at least one direction is short, this can contribute to a reduction in the size of the self-sealing unit 102.

When the self-sealing unit 102 is viewed from the third direction Z, when, among the sizes of the self-sealing unit 102, the size of the self-sealing unit 102 in at least one direction is shorter than the size of the self-sealing unit 102 in the central line C1, this can contribute to a reduction in at least the one directional size of an apparatus using the self-sealing unit 102.

The plane to which the self-sealing unit 102 is fixed is not necessarily limited to the upper surface of the fixing substrate 202 and may be the lower surface of the fixing substrate 201. Furthermore, in this case, it is not necessary that the surfaces of the fixing substrates 201, 202 are flat and the surfaces may have any shape as long as, at least, the self-sealing unit 102 can be fixed to the surfaces.

In the embodiment described above, the surfaces formed by the films 12, 13 are parallel to each other. However, the surfaces may not be exactly parallel to each other. When the films 12, 13 are adhered to the main body 11, for example, wrinkles may occur in the films 12, 13. Furthermore, it is enough as long as the surfaces formed by the two films 12, 13 face each other.

In the embodiment described above, when the self-sealing unit 102 is viewed from the third direction Z, both end surfaces of the main body 11 which are formed as the chamfered portions 32, 33 have a curved line shape, as illustrated in FIG. 3 or the like. However, the end surface may have a straight line shape or a shape constituted by two straight lines or more. In other words, the end surface may have any line shape as long as the line connects the surfaces formed by the two facing films 12, 13.

In the embodiment described above, an ink jet type recording head which ejects ink droplets is exemplified to explain the invention. However, the invention is intended to be widely applied to general liquid ejecting heads. Examples of the liquid ejecting head include a recording head used for an image recording apparatus, such as a printer, a coloring material ejecting head used to manufacture a liquid crystal display or the like, an electrode material ejecting head used to form an electrode for an organic EL display, a field emission display (FED) or the like, and a bio-organic material ejecting head used to manufacture a biochip.

CROSS REFERENCES TO RELATED APPLICATIONS

This application claims priority to Japanese Patent Application No. 2013-270568 filed on Dec. 26, 2013. The entire disclosure of Japanese Patent Application No. 2013-270568 is hereby incorporated herein by reference.

What is claimed is:

1. A liquid ejecting apparatus comprising:

a transporting unit which transports a medium in a predetermined transporting direction;

a liquid ejecting head main body which ejects liquid onto the medium; and a self-sealing unit which has a plurality of self-sealing valves in a state where film surfaces acting as a diaphragm face each other and causes the liquid to flow to the liquid ejecting head main body, wherein the self-sealing valve opens/closes a flow path with a valve body which moves in accordance with displacement of the film surface, wherein, when viewed from a liquid ejecting direction, the self-sealing unit is arranged in a state where a central line is inclined with respect to the transporting direction, a plurality of the valve bodies are spaced apart in the transporting direction, and both end surfaces of the self-sealing unit, which intersect with the transporting direction, are chamfered, and wherein the central line is equidistant from the two film surfaces and perpendicular to the liquid ejecting direction.

2. The liquid ejecting apparatus according to claim 1, wherein, when viewed from the liquid ejecting direction, the self-sealing unit has a configuration in which, in an imaginary rectangle connecting intersection points at which the chamfered end surfaces intersect with the two film surfaces, an angle on the valve body side is an obtuse angle and an angle on the diaphragm side is an acute angle.

3. The liquid ejecting apparatus according to claim 1, wherein, when viewed from the liquid ejecting direction, the size of the self-sealing unit in the transporting direction is smaller than that in the central line.

4. The liquid ejecting apparatus according to claim 1, wherein, when a plurality of the diaphragm portions are projected in a direction perpendicular to the central line, in a state where the diaphragm portions are viewed from the liquid ejecting direction, the diaphragms partially overlap.

5. The liquid ejecting apparatus according to claim 1, wherein the self-sealing unit discharges liquid which is supplied from one side in the liquid ejecting direction, to the other side through the diaphragm, wherein an outlet portion through which the liquid flows out from the diaphragm is located further on the one side than the valve body, and wherein a flow path through which the fluid flows from the outlet portion to the other side is arranged in a portion between shafts of the plurality of valve bodies.

6. The liquid ejecting apparatus according to claim 1, further comprising:

a first member which is located further on one side in the liquid ejecting direction than the self-sealing unit; and a second member which is located further on the other side than the self-sealing unit, wherein the self-sealing unit is fixed in a state where the self-sealing unit is interposed between the first member and the second member.

7. A self-sealing unit comprising:

two film surfaces which face each other;

two end surfaces which intersect with the two film surfaces; and a plurality of self-sealing valves, wherein the self-sealing valve has a diaphragm which is formed by the film surface and a valve body which moves in accordance with displacement of the film surface and opens/closes a flow path, and wherein, when viewed from a direction perpendicular to a plane to which the self-sealing unit is fixed, among diagonal lines connecting intersection points between the two end surfaces and the two film surfaces, the length of a diagonal line connecting the intersection points on the diaphragm sides is longer than that of a diagonal line connecting the intersection points on the valve body sides.

8. The self-sealing unit according to claim 7, wherein, when viewed from the direction perpendicular to the plane to which the self-sealing unit is fixed, the size, in at least one direction, between the two end surfaces is smaller than the size in a central line which is equidistant from the two film surfaces.

9. The self-sealing unit according to claim 7, wherein, when a plurality of the diaphragms are projected in a direction perpendicular to the central line, in a state where the diaphragms are viewed from the direction perpendicular to the plane to which the self-sealing unit is fixed, the diaphragm portions partially overlap.

10. The self-sealing unit according to claim 7, wherein the self-sealing unit discharges liquid which is supplied from one side in the direction perpendicular to the plane to which the self-sealing unit is fixed, to the other side through the diaphragm, wherein an outlet portion through which the liquid flows out from the diaphragm is located further on the one side than the valve body, and wherein a flow path through which the fluid flows from the outlet portion to the other side is arranged in a portion between shafts of a plurality of the valve bodies.

11. The self-sealing unit according to claim 7, wherein the self-sealing unit is fixed in a state where the self-sealing unit is interposed between a first member which is located further on one side than the self-sealing unit in the direction perpendicular to the plane to which the self-sealing unit is fixed and a second member which is located further on the other side than the self-sealing unit.

12. A liquid ejecting head comprising:

a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber; and the self-sealing unit according to claim 7 which supplies the liquid into the pressure generation chamber in such a manner that negative pressure acts on the diaphragm of the self-sealing unit according to claim 7 in accordance with ejection of the liquid through the nozzles and the self-sealing valve is opened in accordance with action of the negative pressure.

13. The liquid ejecting head comprising:

a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber; and the self-sealing unit according to claim 8 which supplies the liquid into the pressure generation chamber in such a manner that negative pressure acts on the diaphragm of the self-sealing unit according to claim 8 in accordance with ejection of the liquid through the nozzles and the self-sealing valve is opened in accordance with action of the negative pressure.

14. The liquid ejecting head comprising:

a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber; and the self-sealing unit according to claim 9 which supplies the liquid into the pressure generation chamber in such a manner that negative pressure acts on the diaphragm of the self-sealing unit according to claim 9 in accordance with ejection of the liquid through the nozzles and the self-sealing valve is opened in accordance with action of the negative pressure.

15. The liquid ejecting head comprising:

a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber; and the self-sealing unit according to claim 10 which supplies the liquid into the pressure generation chamber in such a manner that negative pressure acts on the diaphragm of the self-sealing unit according to claim 10 in accordance with ejection of the liquid through the nozzles and the self-sealing valve is opened in accordance with action of the negative pressure.

16. The liquid ejecting head comprising:

a head main body which has a pressure generation chamber that communicates with nozzles, a pressure generation unit that discharges liquid through the nozzles in such a manner that the pressure generation unit generates change in the pressure of the liquid received in the pressure generation chamber, and a liquid flow path through which the liquid is introduced into the pressure generation chamber; and the self-sealing unit according to claim 11 which supplies the liquid into the pressure generation chamber in such a manner that negative pressure acts on the diaphragm of the self-sealing unit according to claim 11 in accordance with ejection of the liquid through the nozzles and the self-sealing valve is opened in accordance with action of the negative pressure.

* * * * *